US005458532A

United States Patent [19]

Cannone

[11] Patent Number: 5,458,532

[45] Date of Patent: Oct. 17, 1995

[54] UNDULATING EDGED PAD HOLDER FOR ROTARY FLOOR POLISHERS

[76] Inventor: Salvatore L. Cannone, 176 Albany Shaker Rd., Albany, N.Y. 12211

[21] Appl. No.: 180,289

[22] Filed: Jan. 12, 1994

[51] Int. Cl.[6] ..... B24B 29/00

[52] U.S. Cl. ..... 451/353; 451/350; 451/359; 451/511

[58] Field of Search ..... 51/170 R, 170 T, 51/170 TL, 174, 175, 177, 180, 363, 376, 395, 396, 407, 458, 377, 378, 379, 170 PT

[56] References Cited

U.S. PATENT DOCUMENTS

| | | | |
|---|---|---|---|
| 2,990,661 | 7/1961 | Hackett | 51/379 |
| 3,110,140 | 12/1963 | Reames | 51/379 |
| 5,185,964 | 2/1993 | Englund et al. | 51/395 |

*Primary Examiner*—Bruce M. Kisliuk
*Assistant Examiner*—Eileen P. Morgan

[57] ABSTRACT

There are disclosed, in combination, a resiliently compressive, porous rotary buffing pad and a pad holder adapted for use in floor polishing machines. The pad holder is of one piece construction and is formed about its perimeter and toward its center with areas which compress the pad to increase friction with a floor during polishing while reducing overall energy requirements. Immediately adjacent to each such compression area the pad holder defines an area which does not contact the pad and which promotes filtering and storage of particulates. This combination, with adjacent integrally connected compression, non-compression areas promotes efficient polishing with reduced energy resulting from the use of discreet compression areas; and dust or particulate absorption and storage within the non-compression areas.

3 Claims, 2 Drawing Sheets

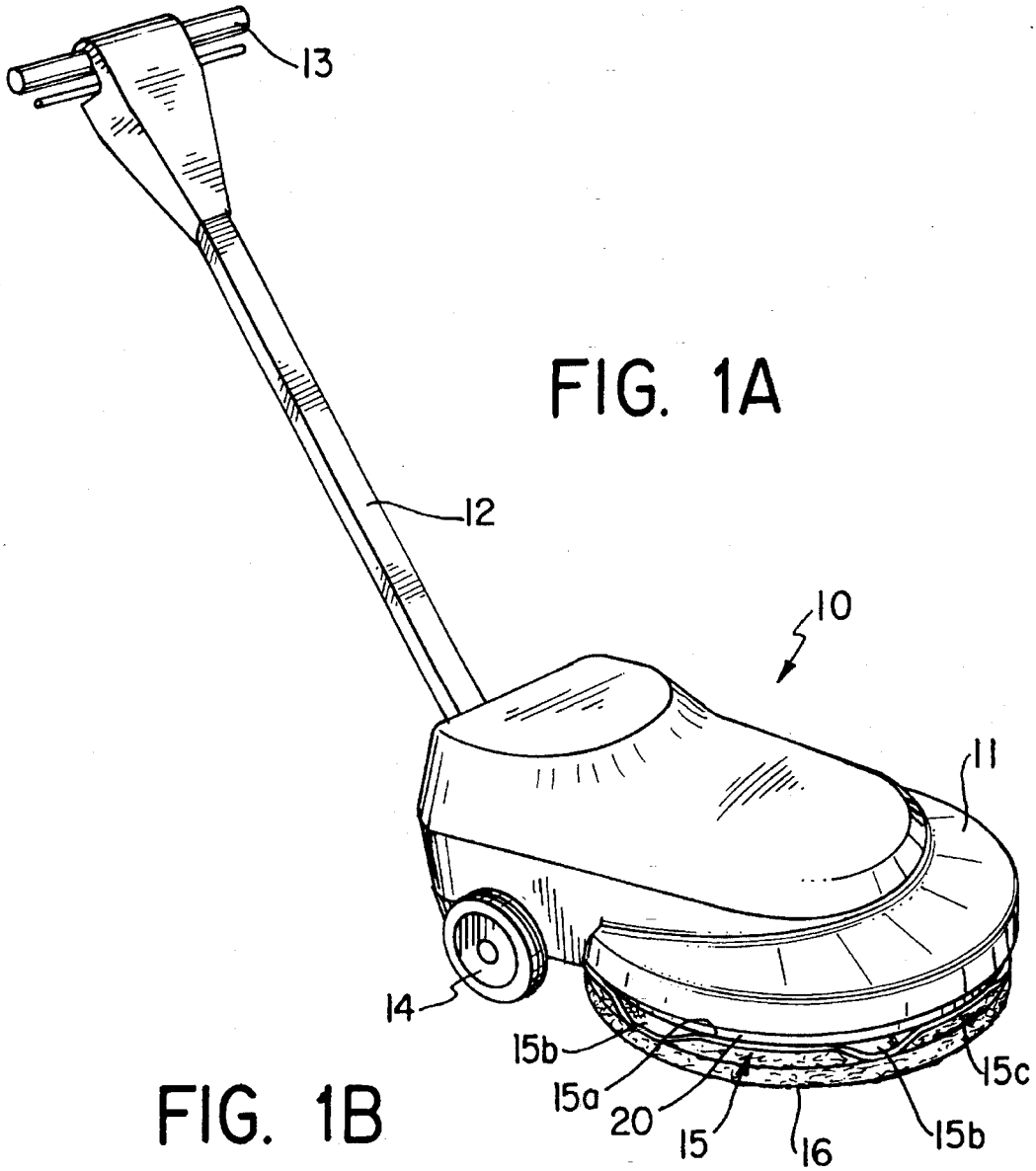
FIG. 1A
FIG. 1B
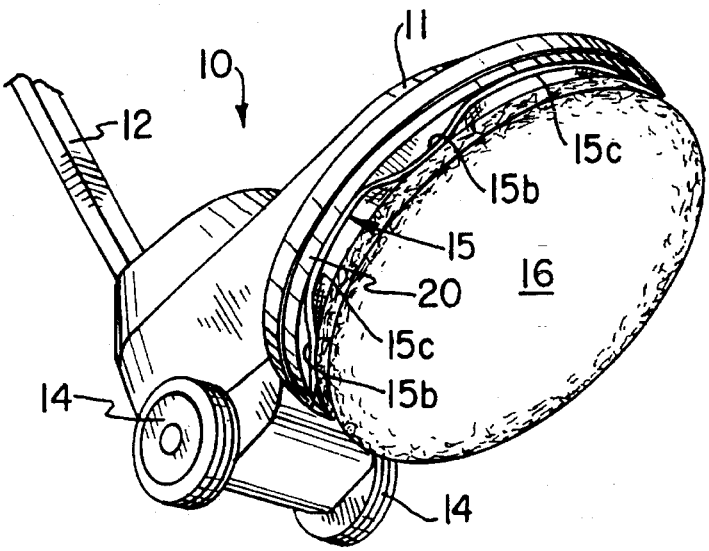

UNDULATING EDGED PAD HOLDER FOR ROTARY FLOOR POLISHERS

BACKGROUND OF THE INVENTION

The present invention has application in the field of floor polishing and more specifically, involves a uniquely designed pad holder for floor polishing machines. One of the problems associated with present rotary floor polishing machines is how to obtain sufficient frictional contact and speed between the polishing pad and the floor while satisfying the power output of the machine. In order to obtain the results desired, i.e. high gloss and removal of scuff marks, sufficient pad pressure and speed of rotation are required. In order to maintain RPM's, floor polishers are currently manufactured with height adjustments to raise or lower buffing pad from contact to the floor surface. However, this will severely reduce the pad pressure required to obtain desired results. Alternatively if pad pressure is increased, more amperage will be required of standard 15 to 20 AMP circut breakers than these floor polishers will accommodate. Therefore, desired results are not obtained.

Another problem associated with present commercial floor polishing is the equipment provided to remove and collect the wax dust or particulates which necessarily accompany the polishing process. To solve this problem, manufacturers of commercial floor polishers have vacuum exhaust means for such dust removal and collection which not only adds considerably to the cost of these machines but also adds to the amperage requirements during normal operation of a machine, or reduces the power available for actual polishing.

The concept and design underlying the pad holder of the present invention solves the above-mentioned problems uniquely and in a cost-efficient manner.

SUMMARY OF THE INVENTION

The concept underlying the present invention is in combination with a rotary floor polisher having a motor, buffing pad holder mounting means and means for mounting the pad thereto to effect polishing of a floor surface, is to provide a pad holder of unique design and effect when mounted intermediate the pad and floor polishing machine. The buffing pad utilized herein shall be compressively resilient, of a material (for example, polyester) suitable for polishing floor wax and sufficiently porous to admit and absorb particulate material in a particular manner which shall be discussed. The pad holder of the invention shall be molded or formed of suitable material (preferably of plastic material having sufficient rigidity and strength) to induce an important effect required by the inventive concept upon the pad during the polishing operation. Accordingly, the pad holder shall be of generally circular configuration approximating the size and configuration of the pad, the holder defining a plurality of integrally connected perimetrical undulations, each extending for a distance toward the center of the holder, alternate ones of such undulations extending downwardly toward and in contact with the pad and therebetween alternate ones extending upwardly toward the floor polishing machine and with no pressure contact, such a that the holder undulations in contact with the pad cause the area of pad being contacted to be compressed against a floor surface during polishing while the holder undulations on each side thereof and the areas thereof which extend away from the pad, minimize pad contact therefore promote and permit absorbtion of wax particulate material during polishing and propagation of wax particulate material into and throughout uncompressed areas of the pad.

BRIEF DESCRIPTION OF THE DRAWING

FIGS. 1A and 1B are overall views in perspective of a floor polishing machine incorporating the buffing pad holder of the present invention;

DESCRIPTION OF A PARTICULAR EMBODIMENT

Figure 2A:
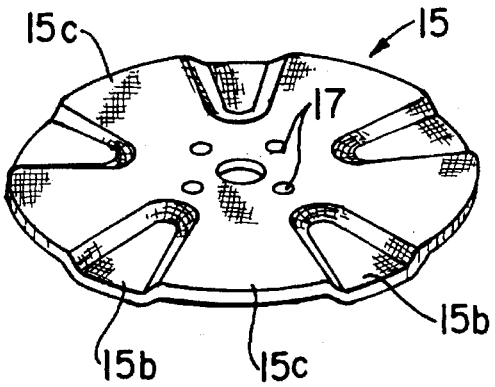
FIGS. 2*a* and 2*b* are respectively top and bottom views, in perspective, of the pad holder of the present invention.

Referring now to the drawing, a floor polisher 10 has been illustrated which incorporates a pad holder 15 constructed according to the principles of the present invention. The details of construction of the polisher 10 have not been illustrated since these are well known, comprising as shown a housing 11 for an electric drive motor (not shown), handle shaft 12, handles 13 and wheels 14, enabling the housing 11 to be tipped backward (FIG. 2A) to permit attachment of the pad holder 15 of the invention and to the holder 15, a circular buffing pad 16.

Figure 2B:
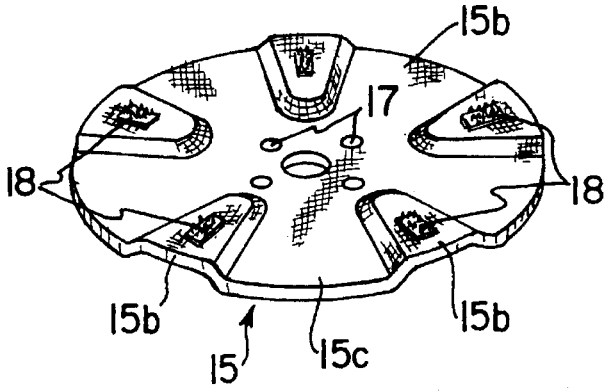

Pad holder 15 has been provided with drilled holes 17 therein, the disposition thereof matching threaded openings in a rotary driving plate (20) provided in the polisher 10 so that the pad holder 15 may be bolted to and driven by the polisher 10. The lower surface 15*a* (FIG. 2*b*) of pad holder 15 has mounted thereupon velcro strips 18 to which buffing pad 16 shall be attached. Pad 16 is a relatively porous, circular pad which has been molded of compressively resilient polyester material having an approximate thickness of one inch. The porosity and compressive resilience of pad 16 is important to the operation of the present invention as shall be explained.

Referring to the pad holder 15, it will been seen that when viewed from its upper surface, (FIG. 2A) five semi elliptical depressed areas 15*b* have been made therein, beginning adjacent to the center and extending to the periphery of the holder. Thus the edge of the pad holder 15 presents an undulating appearance with each depressed area 15*b* located intermediate and adjacent to a raised section 15*c*. It will be understood that each section 15*c* is "raised" only in relation to an adjacent depressed area 15*b* of the pad holder 15. Each section 15*c* for purposes of this description shall include all the area of the pad holder 15 except depressed areas 15*b*.

Figure 3:
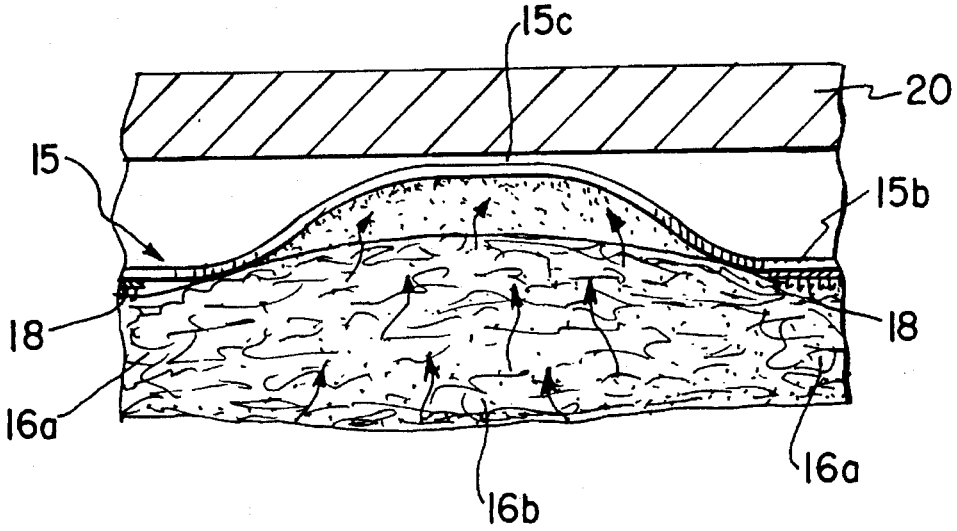
FIG. 3 illustrates the dynamics of compression and particulate suction induced upon pad attached to the pad holder of the invention, during operation of a floor polishing machine.

When the holder 15 and pad 16 are attached to the polisher and the pad 16 is brought into contact with a floor surface as shown in FIG. 3, the weight of the machine will cause each depressed area 15*b* to compress the pad 16 beneath such area (reference numeral 16*a*) thereby increasing frictional contact with the floor surface and increasing the polishing effect upon the floor surface in contact therewith. Conversely, immediately adjacent to each such compressed pad section 16*a*, the pad sections 16*b* adjacent thereto underlie sections 15*c* and consequently shall be free from any such compression force from the pad holder 15. It is preferred that the respective compression areas 15*b* and non-compression areas 15*c* be proportionately sized such that the area effecting compression be approximately fifteen to twenty percent of the total pad area.

It has been determined that the undulating design provided herein respective of immediately adjacent compression, non-compression areas 15*b*, 15*c* shall induce an upward suction within each uncompressed pad section 16*b*. This effect together with the porosity of each such pad section causes particulate material resulting from the polishing action of adjacent compressed pad sections 16*a* to be drawn upward into and throughout each pad section 16*b* and throughout all uncompressed areas of pad 16. Thus each uncompressed portion of pad 16 acts as a filter and collector for particulate dust (similar to, for example, a furnace or air conditioning filter) eliminating the need for separate vacuum suction and removal of such particulate material. Testing has proven that a single pad 16 can store particulate material from a polished floor surface comprising at least fifty thousand square feet.

The pad holder and pad of the present invention uniquely and synergistically cooperate to provide the following:

1) increased polishing efficiency by selectively increasing friction without increasing power requirements;
2) elimination of the need for contemporary systems for particulate collection and storage and with such elimination, reduction in power requirements and machine cost.

It will be understood that the within invention has been described with respect to a particular embodiment which has been representative, and that changes may be made therefrom without departing from the content of the invention. In order therefore to properly understand the scope of the invention, reference should be made to the appended claims.

I claim:

1. In combination with a rotary floor polisher having a motor, means for connecting said motor to a buffing pad holder mounting means for rotation thereof, a polishing pad, and means for securing said pad to said pad holder, the improvement comprising:

a) a generally circular buffing pad of disc-like configuration, said pad being of compressively resilient porous material suitable for polishing a floor to which a layer of wax has been previously applied, said pad being sufficiently porous to admit air flow therethrough while receiving and retaining particulate material resulting from polishing said wax layer after application thereof to a floor;

b) a substantially rigid pad holder of generally circular configuration approximately the same size as said pad, said pad holder defining a plurality of integrally connected perimetrical undulations each extending radially from the edge of said pad holder for a distance toward the center of said pad holder;

c) alternate ones of said undulations extending toward and into contact with said pad when said pad is attached to and rotated by said holder comprising means to cause sections of said pad beneath said undulations to be resiliently compressed against said floor to cause polishing thereof;

d) alternate ones of said undulations between said pad compressing undulations extending away from contact with said pad toward and against said mounting means to produce uncompressed areas of said pad, such undulations comprising means to induce suction within each uncompressed pad area to draw particulate material upwardly into and throughout each uncompressed pad area to be collected and retained therein.

2. The combination according to claim 1 wherein said undulations in said pad holder are formed as evenly spaced, semi-elliptical depressions in the surface of said pad holder attached to the pad holder mounting means.

3. The combination according to claim 1 wherein the areas of the pad holder effecting compression of the pad are approximately fifteen to twenty percent of the total area of the pad holder.

* * * * *